US006964542B1

(12) United States Patent
Sullivan

(10) Patent No.: US 6,964,542 B1
(45) Date of Patent: Nov. 15, 2005

(54) PIN AND COLLAR SHORING DEVICE

(76) Inventor: James G. Sullivan, 10013 Norwood St., Rosemont, IL (US) 60018

( * ) Notice: Subject to any disclaimer, the term of this patent is extended or adjusted under 35 U.S.C. 154(b) by 0 days.

(21) Appl. No.: 10/826,093

(22) Filed: Apr. 16, 2004

Related U.S. Application Data

(63) Continuation-in-part of application No. 10/252,255, filed on Sep. 23, 2002, now Pat. No. 6,746,183.

(51) Int. Cl.[7] ..... A47F 5/00; E04G 25/04

(52) U.S. Cl. ..... 405/272; 405/278; 405/282; 248/354.7; 254/93 R

(58) Field of Search ..... 405/272, 274, 405/276–279, 282, 283, 288, 292, 294; 299/31; 248/354.1, 354.3, 354.7, 357; 254/93 R, 254/98, 89 R

(56) References Cited

U.S. PATENT DOCUMENTS 1,170,992 A * 2/1916 Purdy ..... 254/98
3,362,168 A * 1/1968 Dotlich ..... 405/283
3,851,856 A * 12/1974 Berg ..... 254/93 R
3,870,278 A * 3/1975 Lee ..... 248/354.3
4,375,934 A * 3/1983 Elliott ..... 248/354.7
4,441,736 A * 4/1984 Shedden ..... 248/354.3
4,486,050 A * 12/1984 Snyder ..... 299/31
5,094,576 A * 3/1992 Fredelius ..... 410/151
5,199,824 A * 4/1993 Smith et al. ..... 405/282
5,310,290 A * 5/1994 Spencer ..... 405/283
5,590,863 A * 1/1997 Sasaki ..... 248/354.3
6,256,939 B1 * 7/2001 Snyder ..... 248/354.3
6,371,422 B1 * 4/2002 St. Martin et al. ..... 248/354.3
6,394,405 B1 * 5/2002 Roxton et al. ..... 248/354.1

FOREIGN PATENT DOCUMENTS

GB 2231353 * 11/1990

* cited by examiner

*Primary Examiner*—Jong-Suk (James) Lee
(74) *Attorney, Agent, or Firm*—Adrienne B. Naumann, Esq.

(57) ABSTRACT

A shoring device is disclosed comprising a piston and a cylinder. The piston is axially expanded by compressed gas, whereby the shoring device engages two opposing surfaces. An outer cam collar and a concentrically enclosed inner ring are mounted upon the cylinder end into which the piston inserts. This outer cam collar comprises at least two cam edges, two stop faces and a threaded cam pin within an integral boss. The inner ring comprises a continuous circular indentation as well as a continuous circular inner lip. The outer cam collar and inner ring, together with the continuous circular inner lip and threaded pin, firmly retain the piston. These piston retention features prevent inadvertent rotation and collapse of the piston during use.

21 Claims, 5 Drawing Sheets

103b
103f
135b
136b
120b
137b
139b
138b
141a
131a
105b
129a
141b
130b
130c
6
107t
104b
5
113i
113h
128d
131
129
10k
102
102k
128e
101
164ff
102c
156a
164gg
155b
156e
156
156d
155m
164b
155c
155q
4
160a
104a
111
164c
160b
155e
155a
105a
155
155f
103d
103c
139a
103a
137a
103e
135a
136a
138a
120a
170
107f
107g
107i
107a
107c
113
107
113j
181c
102
101
169b
155
160b
111
160a

PIN AND COLLAR SHORING DEVICE

CROSS-REFERENCE TO RELATED APPLICATION

This application is a continuation in part of U.S. patent application Ser. No. 10/252,255, filed Sep. 23, 2002, now U.S. Pat. No. 6,746,183.

Attached are Exhibits A and B (Shoring and Trenching Data).

BACKGROUND OF THE INVENTION

My invention relates to a shoring device comprising a piston, cylinder, and an outer cam collar combined with an inner ring. More particularly, this invention relates to a shoring device for trenches with a removable rotating outer cam collar. This outer cam collar encloses an inner ring with a continuous circular indentation along the inner ring circumference. This inner ring also comprises an inner continuous circular lip. My new outer cam collar insures that the partially enclosed piston does not rotate during use. My new shoring device is intended for, but not exclusively, public works and construction, rescue and other projects in which shoring is necessary.

As workers shore trenches, they must quickly install shoring to prevent collapse of the trench walls. If shoring is not installed, soil cohesion is lost and it becomes almost impossible to maintain a safe trench. The prior art as best depicted in expired U.S. Pat. No. 3,851,856(Berg) provides a shoring device with an inlet connecting to a pressure source for expanding the device tightly against trench walls. There is also a cylindrical collar mounted on one cylinder end, which receives the piston. This cylindrical collar extends axially from the cylinder and surrounds the proximal piston end.

Still referring to the Berg device, the cylindrical collar comprises two camming surfaces along the cylindrical collar's proximal edge. Subsequent to cylinder pressurization the piston remains extended by the securing of one camming surface with a pin. In addition, a threaded stud abuts and tightens against the cylinder by an attached handle. This threaded stud penetrates the rotating collar and abuts the cylinder after the cam pin is placed against the camming surface.

This abutting threaded stud prevents relative rotation of the cylindrical collar to the cylinder. The threaded stud also locks the cylindrical collar against the pin, thereby preventing the rotating collar from loosening. However, this threaded stud is the only structure in Berg's device which prevents the cylindrical collar from rotating after cessation of the gas pressure.

Furthermore, Berg's threaded stud only contacts one point along the cylinder exterior surface and weakens the cylinder structure after each application. Inevitably, the entire cylinder must be replaced, and this replacement is expensive and time consuming. In contrast, my continuous circular indentation prevents the flat threaded pin furthermost point from skidding along the cylinder surface. The cylinder is not weakened by repeated contract, because the outer cam collar provides the direct contact surface. My outer cam collar is more economical to replace, and protects the cylinder from wear and tear from the threaded pin.

In addition, my inner ring comprises a continuous circular lip which abuts the piston and prevents it from falling from the cylinder or becoming a projectile during operation.

My new inner ring engages one cylinder end, thereby reducing the possibility that the piston will fall from the cylinder during operation. This metal lip abuts the piston to prevent piston lateral movement, which is an important safety advantage which the Berg device does not have.

In my invention the outer cam collar encloses the inner ring and comprises the threaded pin which tightly abuts the circular continuous indentation. The cam edges, together with a straight metal cam pin, prevent counter-clockwise rotation of the outer cam collar. My improved shoring device is engineered to assist underground workers in compliance with the OSHA regulation governing excavations, i.e., 29 C.F.R. 1926.650. This group includes, but is not limited to, sewer contractors, plumbers, gas companies, telephone companies, municipal public works departments and fire rescue services. The principle goal of my shoring device is to provide the necessary physical support which ensures a work environment safe from collapse.

In particular, shoring is the placement of cross bracing and other components within a trench to support trench walls. There are two important theories of shoring: first is the theory of "zero-movement", in which shoring is designed to prevent wall movement. Shoring is not sufficiently strong to retain a moving wall of soil: it merely prevents a soil wall from initially moving. The second theory of shoring is designated the "Arch Effect." Shoring is effective because it creates forces as it pushes again trench walls. The network of cross braces and uprights or wale-plates creates an arch effect which retains soil. The shoring and cross bracing actually retains soil, and not the plywood or sheeting.

An operator applies plywood or sheeting to prevent surface soil from falling and injuring a worker. To achieve "zero movement" and the "arch effect," all gaps and voids must be filled where the cross brace bears on the trench wall. Other than the mandatory inspection for damage before each use and an occasional cleaning, there are no maintenance requirements.

My preferred pneumatic shoring device also comprises a contiguous pressurized gas channel through the cylinder to the piston. In the best mode, this contiguous pressurized gas channel includes a circular channel segment along the lower floor surface of a cylinder rubber end cup.

SUMMARY OF THE INVENTION

My improved shoring device is much safer than, yet remains just as cost effective, as the prior art. The new crucial safety feature comprises an inner ring with a continuous circular inner lip, together with an outer cam collar with a threaded pin within a boss. The outer cam collar concentrically encloses the inner ring, and both the outer cam collar and inner ring concentrically enclose a cylinder which contains a piston.

Release of the outer cam collar in a counterclockwise direction requires the operator to manually twist the threaded pin counter-clockwise, thereby releasing it from a continuous circular indentation along the inner ring exterior surface. The inner ring greatly reduces the likelihood that the piston will become a projectile, because a rubber piston cup attached to a cylinder plug cannot move beyond the continuous circular lip. The inner ring also comprises an inner circular continuous lip which abuts the distal piston end when my shoring device 100*a* is fully assembled. The inner circular continuous lip prevents the piston from becoming a projectile and falling from the cylinder.

The piston is cylindrical in shape and inserts within a cylinder of greater diameter. The piston also comprises a plurality of aligned apertures, into which a straight metal cam pin inserts. This metal cam pin, in combination with the outer cam collar, prevents the piston from retracting into the cylinder, once the air pressure is removed. This straight metal cam pin is inserted into a pair of piston apertures which are closest to the outer cam collar edge. The operator then manually rotates the outer cam collar until it abuts this inserted straight metal cam pin. After this last step, the operator manually rotates the threaded pin within its boss until the threaded pin abuts the floor of the inner ring's circular continuous indentation.

The inner ring encloses the proximal cylinder end and is mechanically attached to the cylinder with at least two screws. Preferably, my inner ring attaches to the cylinder with allen screws (threaded with hexagonal head depressions). With my shoring device, the initial lateral extension of my assembled improved shoring device occurs whenever pressurized air enters the cylinder during a trench application.

During removal of an installed shoring device pressurized air is re-introduced. Next there is counter-clockwise release of the outer cam collar prior to disengagement of the straight metal cam pin and removal of the pressurized air. In actual field operations, the operator does not remove the air pressure from the shoring device until he or she has moved to a safe position removed from the device.

Each shoring device also comprises two removable swivel side plates. One side plate reversibly attaches to the most distal piston end, while the other similarly attaches to the most proximal cylinder end. My removable swivel side plates comprise adjustable set screws for engagement of wood shoring boards or aluminum wale-plates. Each preferred set screw is approximately ¼ inch in diameter, and comprises twenty threads per inch. Each preferred set screw is also approximately one inch in length. However, other side plates or end adapters are also within the scope of my invention, and may be even preferably for primarily vertical or angled applications, such as buildings or vehicles.

In the preferred embodiment my pneumatic pin and collar shoring device also comprises a cylinder plug. Cylinder plug is hollow at its proximal end to accommodate one removable swivel side plate. The remaining approximate one-half of the cylinder plug is solid metal and comprises a continuous channel for compressed air. In the best mode, the cylinder plug comprises a cylinder rubber end cup at its distal plug end. Cylinder rubber end cup more efficiently prevents air leaks from the air channel within metal cylinder plug.

In the best mode, the cylinder end cup comprises apertures and a circular channel, which contribute to the most efficient airflow from cylinder plug distal end. More preferably, air channel segments lie along the lower floor surface of the cylindrical rubber end cup. This circular channel segment comprises a contiguous aperture through which pressurized air from a gas inlet evenly and quickly seals the raised edge of a piston rubber end cup. The prior art cylinder plug comprises a circular groove around the circumference of the metal cylinder plug, and into which groove a rubber o-ring is inserted.

In the best mode, my preferred improved shoring device is assembled by inserting the piston so that its piston rubber end cup initially abuts cylinder rubber end cup. The inner ring is next inserted over the cylinder end until its circular metal inner lip engages the distal cylinder end. The operator then bolts the inner ring is then bolted to the cylinder. The outer cam collar is next positioned so that it encloses the inner ring.

The outer cam collar has limited movement along the cylinder, but it can be manually rotated and then locked to the inner ring with the threaded pin. At least approximately one-third of the longitudinal axial length of the piston must always remain within the cylinder. After the operator fits the outer cam collar over the inner ring, he or she finally inserts the removable swivel side plates at the distal and proximal end of the shoring device.

For pneumatic applications, my pin and collar shoring device is particularly suited for situations in which only one air pressure value is available. Any single specific air pressure value is generally in the range of approximately 115–150 psi (pounds per square inch). For support of a car or building, my shoring device is manually extended until resistance is felt. Then the operator inserts a straight metal cam pin into appropriate piston apertures. He or she then manually tightens the outer cam collar by rotating the threaded pin until the threaded pin tightly abuts the continuous circular indentation.

Accordingly, it is a goal of my invention to provide a more comprehensive reliable anti-rotational mechanism for a piston within a cylinder.

It is another goal of my invention to provide a safer locking mechanism with an outer cam collar in combination with an inner ring, for a pneumatically driven shoring device.

It is another goal of my invention to provide a device which prevents the piston from ejecting from the cylinder.

It is another goal of my invention to provide cast aluminum handles for manual rotation of outer collar.

These as well as other features of my device are described further in the drawings and the detailed description of the preferred embodiment and other embodiments.

DETAILED DESCRIPTION OF THE PREFERRED EMBODIMENT AND OTHER EMBODIMENTS

Figure 2:
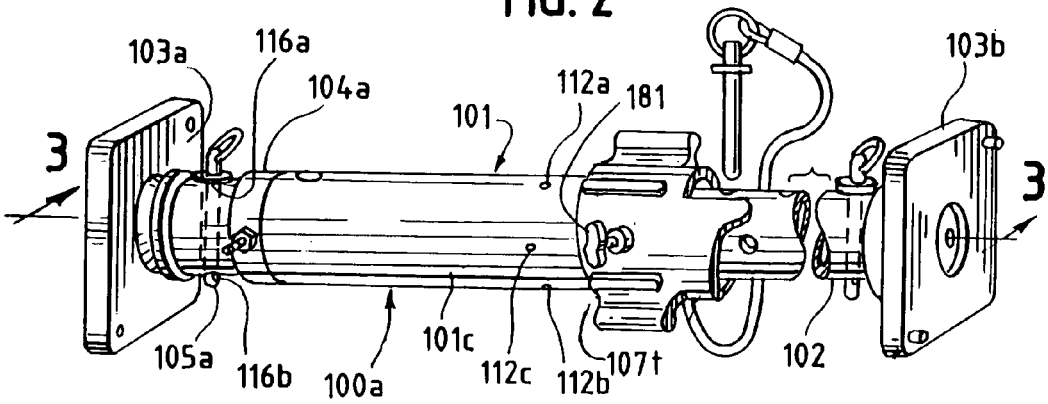
FIG. 2 illustrates a longitudinal prospective view of my improved shoring device with an outer cam collar.
Figures 3, 4, 5, 6:
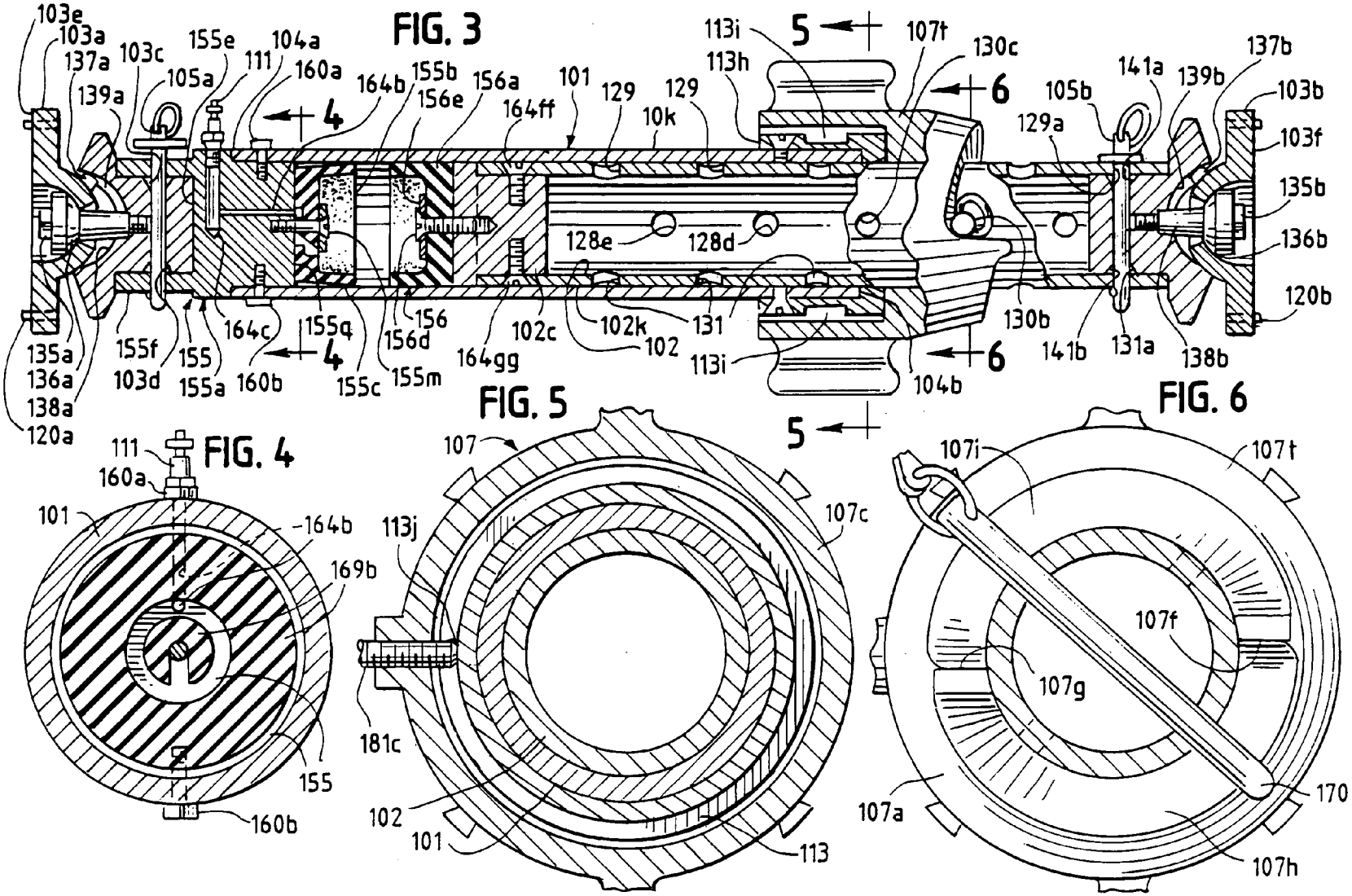
FIG. 3 illustrates a partial transverse longitudinal view of a shoring device through view line 3—3.
FIG. 4 illustrates a cross-sectional view of FIG. 3 taken through view line 4—4.
FIG. 5 illustrates a cross-sectional view of FIG. 3 taken through view line 5—5.
FIG. 6 illustrates a cross-sectional view of FIG. 3 taken through view line 6—6.

Referring initially to FIGS. 2 and 3 of the preferred embodiment, my improved shoring device 100*a* comprises a piston 102, cylinder 101, an outer cam collar 107*a*, and an inner ring 113*a*. Shoring device 100*a* is particularly suited for shoring of trench walls, by using compressed gas to laterally extend piston 102. Shoring device 100*a* is especially suited for situations in which the gas source has only one designated numeric pressure. However, other sources of appropriate lateral force are also within the scope of my invention. My shoring device 100*a* is preferably approximately 43 inches long in its maximum extended configuration, and approximately 33 inches in its most retracted configuration. Three other satisfactory lengths are as follows:

approximately 25 inches when fully retracted and approximately 30 inches when fully extended;

(2) approximately 45 inches when fully retracted position and approximately 65 inches when fully extended; and (3) approximately 67 inches when fully retracted and approximately 102 inches when fully extended.

Other diameters and lengths are also within the scope of my invention. Circular rubber end cups 155*b*, 156 infra, add approximately two inches to every model, so that only cylinder and piston length varies.

Cylinder 101 and Swivel Side Plates 103*a*, 103*b*

Still referring to FIGS. 2 and 3 of the preferred embodiment, my improved shoring device 100*a* comprises a cylinder 101. Cylinder 101 is hollow, preferably approximately 15 inches in length and approximately 3.0 inches in interior diameter. Cylinder wall 101*c* is preferably approximately one-quarter of an inch (¼") thick. Cylinder 101 has a proximal cylinder end 104*a* and distal cylinder end 104*b*.

Figure 1:
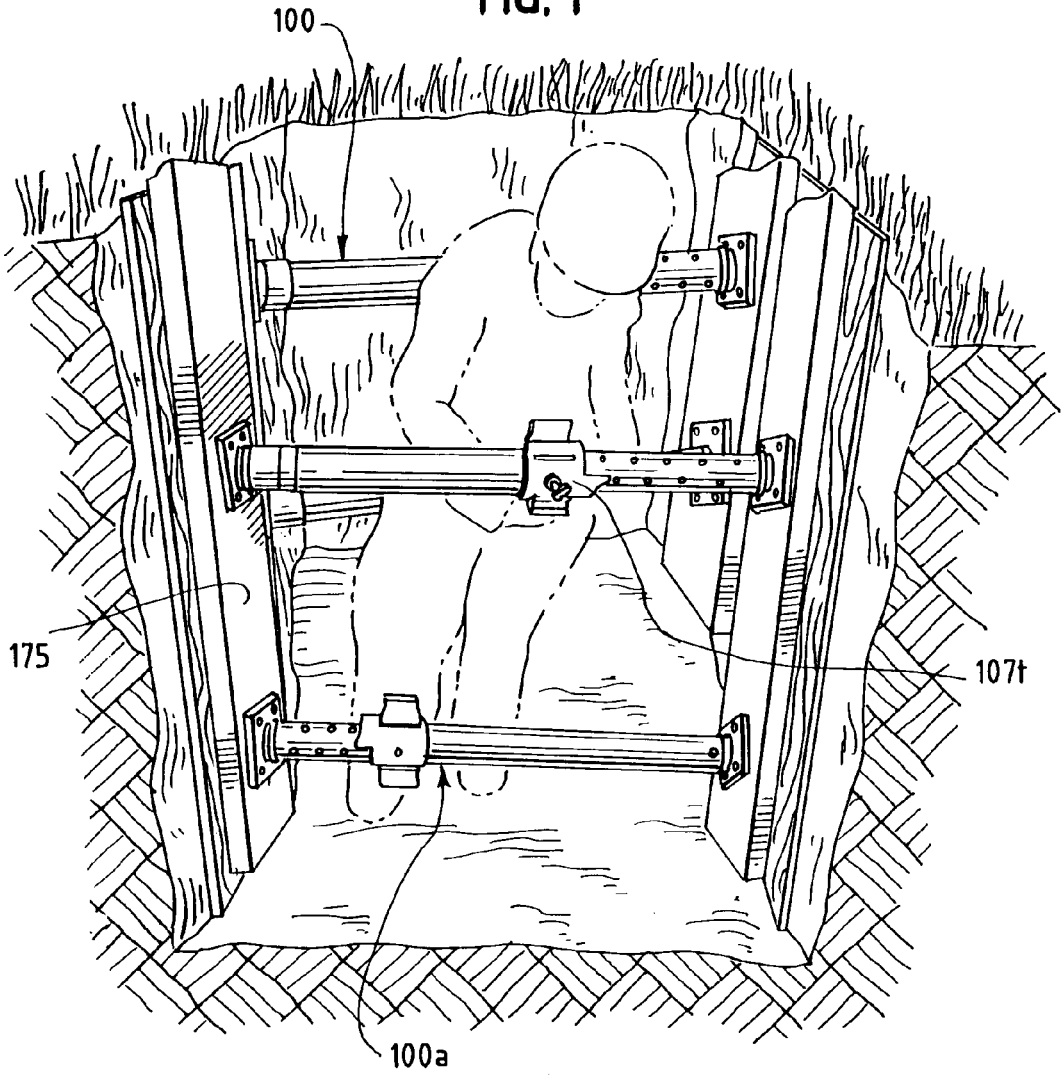
FIG. 1 illustrates an anterior view of operator installing a plurality of shoring devices within a trench.

Cylinder 101 also comprises a removable swivel proximal cylinder side plate 103*a* whenever shoring device 100 is fully assembled. Swivel proximal cylinder side plate 103*a* is identical in structure, size and function to removable swivel distal piston side plate 103*b*, infra. Each swivel side plate 103*a*, 103*b* comprises a plate 103*e*, 103*f* which is preferably approximately five inches in length and width. Each swivel side plate 103*a*, 103*b* also comprises a central screw 135*a*, 135*b* respectively, and a central segment 136*a*, 136*b* respectively. Swivel proximal and distal side plates 103*a*, 103*a* respectively also each comprise at least one adjustable first and second set screw 120*a*, 120*b* respectively, for engagement with wood shoring boards and/or aluminum waleplates 175 (FIG. 1).

Each central segment 136*a*, 136*b* respectively comprises a first and second swivel groove 137*a*, 137*b* respectively. First and second insert portions 138*a*, 138*b* respectively attach within grooves 137*a*, 137*b* respectively, by their first and second insert ridges 139*a*, 139*b* respectively.

Each groove 137*a*, 137*b* containing an insert ridge 139*a*, 139*b* respectively prevents a swivel proximal or distal side plate 103*a*, 103*b* respectively, from swiveling in an unlimited manner. Removable swivel side plates are well known in this particular equipment industry. However, other side plates, base plates or attachments are also within the scope of my invention.

Still referring to FIGS. 2 and 3 of the preferred embodiment, at proximal cylinder end 104*a* is proximal side plate detente pin 105*a*. Proximal side plate detente pin 105*a* connects cylinder 101 to swivel cylinder proximal side plate 103*a* by insertion through (i) first and second proximal side plate swivel apertures 103*c*, 103*d* respectively and; (ii) congruently aligned first and second cylinder end apertures 116*a*, 116*b*.

First and second proximal side plate swivel apertures 103*c*, 103*d* oppose each other at approximately 180 degrees. Cylinder end apertures 116*a*, 116*b* also oppose each other at approximately 180 degrees. Cylinder end apertures 116*a*, 116*b* can congruently align with swivel apertures 103*c*, 103*d* whenever swivel proximal cylinder side plate 103*a* inserts into cylinder 101. Cylinder end apertures 116*a*, 116*b* are approximately one and ¾ inches from cylinder proximal end 104*a*.

Figure 7:
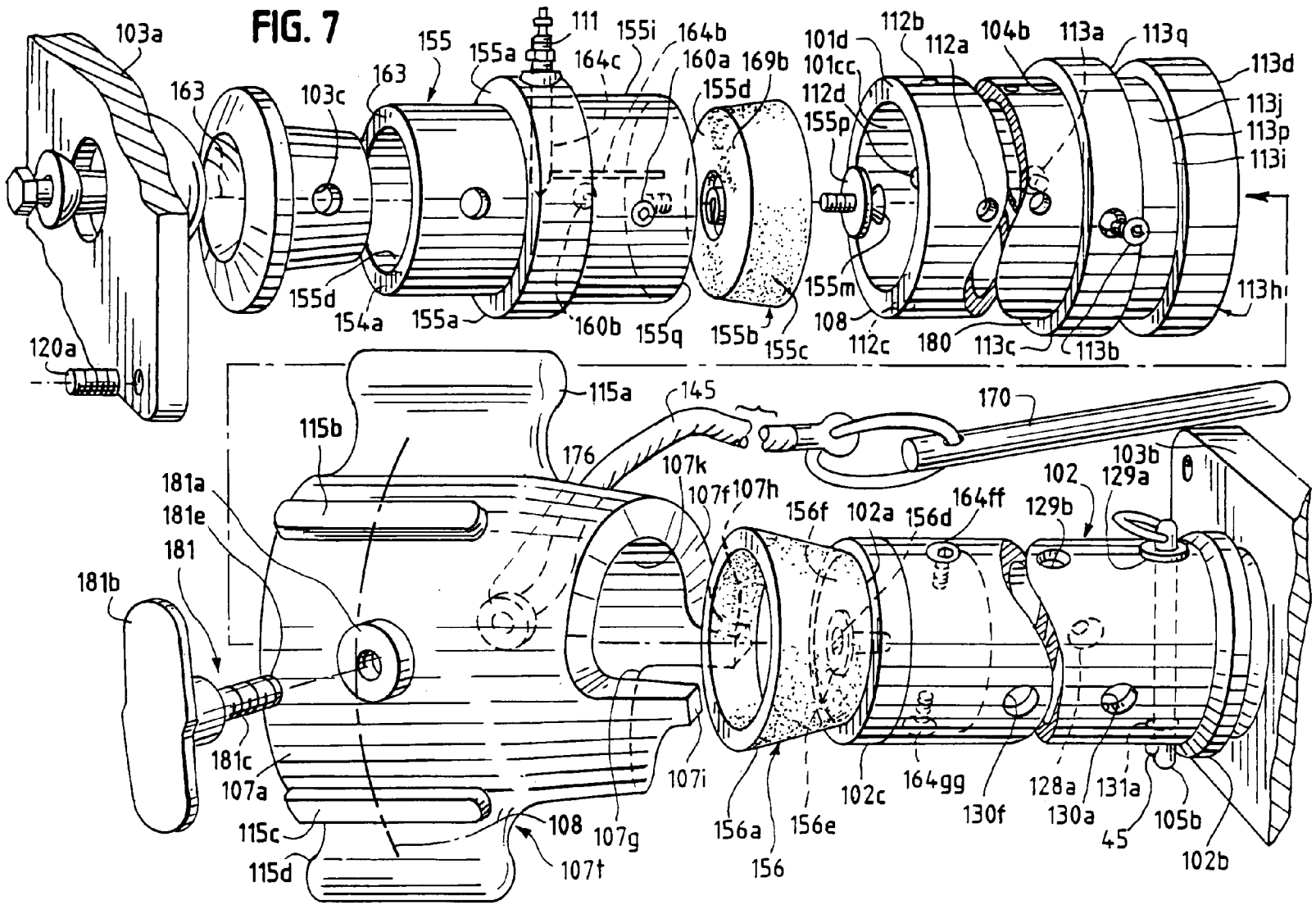
FIG. 7 illustrates an exploded view of the shoring device.
Figure 8:
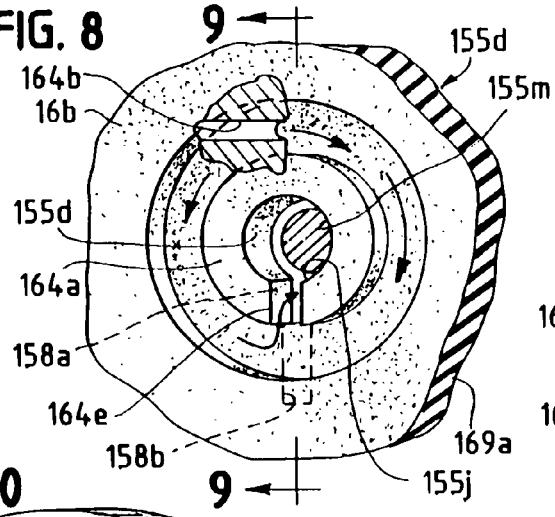
FIG. 8 illustrates an isolated view of lower floor surface of cylinder end cup.

Referring now to FIGS. 3 and 7 of the preferred embodiment, approximately three inches from inserted proximal side plate 103*a*, and approximately 90 degrees from proximal detente pin 105*a*, is compressed gas inlet 111. Compressed gas inlet 111 connects shoring device 100*a* to an external source of compressed gas through cylindrical plug 155, infra.

As seen in FIGS. 2 and 7, small circular vents 112*a*, 112*b*, 112*c*, 112*d* (generically small circular vents 112) for gas exhaust are aligned along a cylinder circumference at intervals of approximately 90 degrees to each other. Small circular vents 112 are approximately one quarter inch in diameter. In the preferred embodiment there are four small circular vents 112, but other numbers are also satisfactory.

Proximal Cylinder Plug 155

Figure 11:
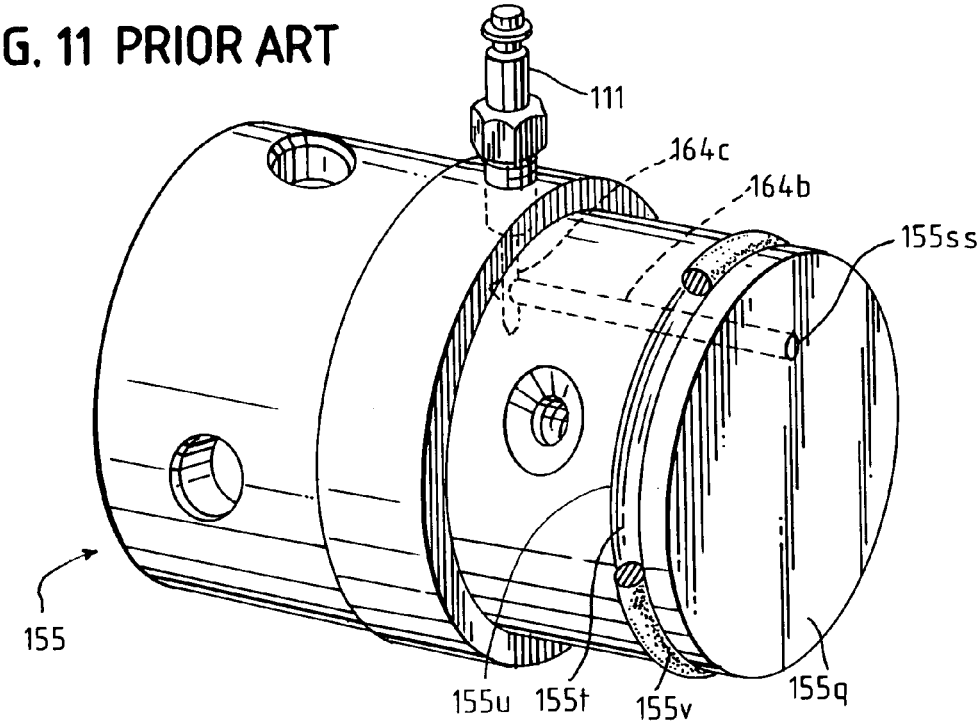
FIG. 11 PRIOR ART
FIG. 11 illustrates a close up of isolated prior art cylinder plug.

Referring now to FIGS. 3, 7, and 11, cylinder plug 155 is part of cylinder 101, and cylinder plug 155 is contiguously attached to cylinder 101 by first and second set screws 160*a*, 160*b* respectively. First and second set screws 160*a*, 160*b* oppose each other at approximately 180 degrees along cylinder 101. Cylinder plug 155 abuts proximal cylinder end 104*a* by circular contiguous ledge 155*a*. Metal contiguous ledge 155*a* is also the cylindrical component into which compressed gas inlet 111 inserts. Cylinder swivels proximal side plate 103*a* inserts into cylinder plug 155 proximal to circular contiguous ledge 155*a*.

Still referring to FIGS. 3 and 7, the inner diameter of cylinder plug 155 is approximately 3.5 inches. Cylinder plug wall 155*f* is preferably approximately ⅔ (two-thirds) inch in thickness at proximal plug end 154*a*. Cylinder plug interior 155*d* comprises a proximal round metal barrier 155*e* which abuts fully inserted swivel proximal cylinder side plate 103*a*.

Referring to FIGS. 3 and 7, in the best mode cylinder plug 155 at distal plug end 155*q* comprises cylindrical end cup 155*b*. Cylindrical end cup 155*b* comprises an outer raised circular rim 155*c*, which faces a piston rubber end cup 156, infra, within a fully assembled shoring device 100. Cylindrical end cup 155*b* comprises the same shape, dimensions and material as piston rubber end cup 156, infra. Cylindrical end cup 155*b* abuts piston rubber end cup 156 by raised circular rim 155*c*, whenever piston 102 is completely inserted within cylinder 101.

Cylindrical end cup 155*b* also comprises a cylindrical end cup floor 155*d* with centrally located bolt aperture 155*j*. Plug bolt 155*m* inserts into bolt aperture 155*j* and thereby attaches distal plug end 155*q* to cylinder end cup 155*b*. Cylinder washer 155*p* surrounds plug bolt 155*m*.

Figure 9:
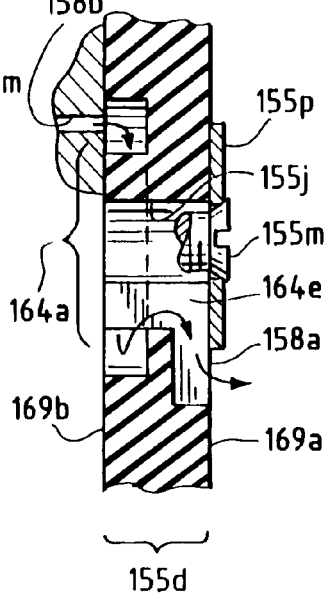
FIG. 9 illustrates a close up cross-sectional view of FIG. 9 taken through view line 10—10.

Initially referring to FIG. 9, in the best mode cylindrical end cup floor 155*d* comprises an upper end cup floor surface 169*a* and a lower end cup floor surface 169*b*. Also referring to FIG. 10 of the preferred embodiment, cylinder end cup 155*b* comprises a lower air aperture 158*b* within its lower end cup floor surface 169*b*, and upper air aperture 158*a* within upper end cup floor surface 169*a*. Lower and upper air apertures 158*a*, 158*b* respectively are integrally connected to each other by (i) a first air channel segment 164*a* within rubber end cup floor surface 169*b*; and (ii) a short air channel segment 164*e* traversing rubber cylinder end cup floor 155*d*.

Figure 10:
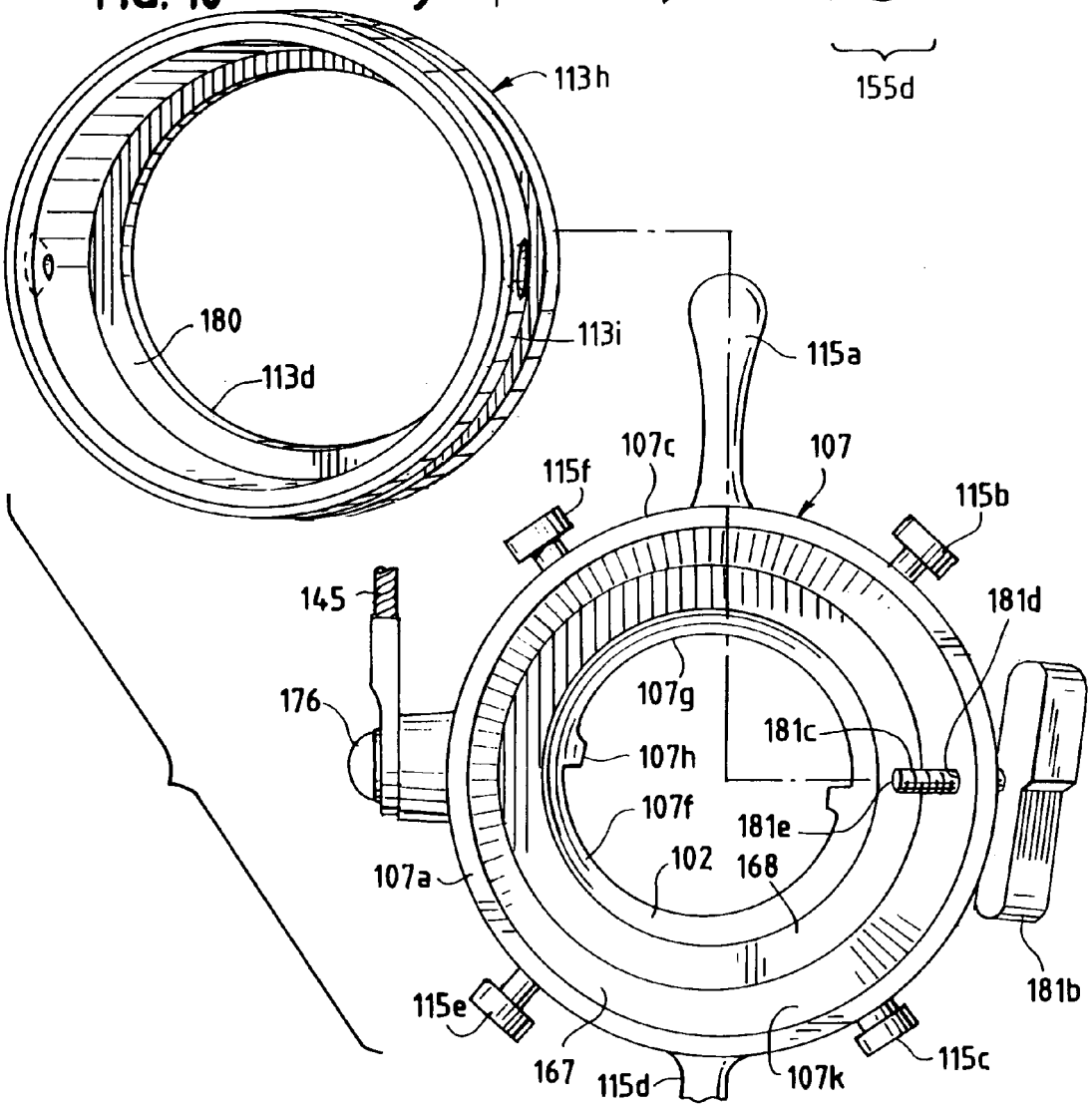
FIG. 10 illustrates an isolated partial anterior view of inner ring with a close up cross-sectional view of the outer cam collar and threaded cam pin.

As best seen in FIGS. 4 and 9, in the best mode first air channel segment 164*a* is circular, approximately one inch in exterior diameter and approximately one-quarter inch in depth along lower cylindrical end cup floor surface 169*b*. As best seen in FIG. 10, short air channel segment 164*e* is adjacent and parallel to bolt aperture 155*j* within end cup floor 155*d*. Short air channel 164*e* connects circular air channel segment 164*a* to upper aperture 158*a*. However, other embodiments of my invention need not comprise a first air channel segment 164*a* which is circular.

Referring to FIGS. 3 and 7, lower air aperture 158*a* is congruent and contiguous with second air channel segment 164*b* within cylinder plug 155. Air channel segment 164*b* is adjacent to and parallel to longitudinal midline 163 of cylindrical plug 155, as seen in FIG. 4. In the preferred embodiment, second air channel segment 164*b* is continuously connected to third air channel segment 164*c*. Third air channel segment 164*c* is approximately perpendicular to second air channel segment 164*b*. Preferably both air channel segments 164*b* and 164*c* are linear in form.

Second air channel segment 164*b* leads towards the outer metal surface of cylinder plug 155, and is continuous with gas inlet 111. Gas inlet 111 is continuously connected to an external source of pressurized gas, such as CO2 or air. Consequently when air is introduced from an exterior source, there is a continuous pressurized gas channel through: gas inlet 111; third and second air channel segments 164*c*, 164*b*; lower air aperture 158*b*; circular first air channel segment 164*a*, short air channel segment 164*e*; and finally upper air aperture 158*a*.

After passing through this pathway, almost instantaneously this pressurized air seals piston end cup raised circular rim 156*a* against inner cylinder wall 101*cc*. FIG. 4 illustrates the physical continuity of lower aperture 158*a* in rubber end cup 155*b*, with metal distal cylindrical plug end 155*q*, with respect to bolt aperture 155*j* and adjacent second air channel segment 164*b*.

Referring to FIG. 11 for other embodiments, prior art cylinder plug 155 comprises a singe end aperture 155*ss* which is continuous with second air channel segment 164*b*. Approximately two inches from cylindrical plug end 155*q* along a cylinder plug circumference 155*u* is circular groove 155*t*. Circular groove 155*t* contains an appropriately sized O-ring 155*v*. O-ring 155*v* prevents air leakage from cylinder end plug 155. Prior art cylinder plug 155 is available from Airshore, infra.

Piston 102

Referring initially to FIGS. 2 and 3 of the preferred embodiment, piston 102 is hollow and cylindrical in shape, approximately thirteen (13) inches in length, and approximately two and one-quarter inches in inner diameter. However, other lengths and diameters are also within the scope of my invention. Piston 102 comprises a piston wall 102*k*, which is approximately ¼-inch (one-quarter) inch in thickness. Piston 102 is narrower in diameter than cylinder 101, into which piston 102 inserts in a removable manner.

Along its longitudinal axis piston 102 comprises four linearly aligned parallel sets of piston apertures 128*a*, 128*b*, 128*c*, 128*d*; 128*e*; 129*a*, 129*b*, 129*c*, 129*d*, 129*e*, 129*f*; 130*a*, 130*b*, 130*c*, 130*d*, 130*e*; and 131*a*, 131*b*, 131*c*, 131*d*, 131*e*, 131*f*(generically opposing piston apertures 128, 129, 130, 131). Representative apertures 128, 129, 130, 131 are best seen in FIGS. 3 and 7, and are preferably approximately 1 and ½ inches in diameter.

Each set of piston apertures 128, 129, 130, 131 is preferably approximately 90 degrees from each adjacent aligned set. However, individual adjacent apertures are preferably aligned at the midpoint of adjacent apertures, as best seen in FIG. 3. Opposing sets 128/130 and 129/131 are approximately 180 degrees from each other, so that straight metal cam pin 170 is inserted through them simultaneously, as best seen in FIG. 7.

Four linearly aligned sets are preferred, but other numbers of linearly aligned sets are also within the scope of my invention. There are also preferably two opposing sets of five apertures per linearly aligned set (128, 130), and two opposing sets of six apertures (129, 131) per linearly aligned set. However, other numbers of piston apertures are also within the scope of my invention.

Still referring to FIGS. 3 and 7, in a fully assembled shoring device 100*a*, piston 102 is closed at most distal end 102*b* by swivel piston distal side plate 103*b*. Swivel piston distal side plate 103*b* is attached within piston 102 by insertion of piston detente pin 105*b* within:

(i) piston apertures 128/130 or 129/131 and (ii) first and second swivel side plate apertures 141*a*, 141*b* respectively.

Piston apertures 128/130 or 129/131 and side plate apertures 141*a*, 141*b* must be congruently aligned with each for insertion of piston detente pin 105*b*.

Still referring to FIGS. 3 and 7, at its proximal end 102*a* piston 102 is capped by metal piston end wall 102*c*. Metal piston end wall 102*c* is secured to piston 102 by first and second opposing screws 164*ff*, 164*gg* respectively. Metal piston end wall 102*c* is flush with piston wall 102*k*, and is approximately one-half inch in thickness at its proximal end.

A piston rubber end cup 156 is secured to metal piston end wall 102*c* by piston bolt 156*d* extending through metal washer 156*e*. In the center of piston rubber end cup flat circular floor 156*f* (which is preferably approximately three inches in diameter) is piston bolt 156*d*. In other embodiments, piston end cup 156 comprises identical apertures 158 and channel segments 164 to cylinder end cup 155*b*. In fact, in the best mode mass production of end cups 155*b*, 156 is the most economical approach. However, in these embodiments apertures and channels in end cup 156 are covered with a large washer because they have no function in piston end cup 156. In the preferred embodiment and best mode, piston end cup 156 comprises no air apertures or air channel segments of any type. Please see FIGS. 3 and 7.

Circular piston rubber end cup 156 comprises raised circular rim 156*a*, and raised circular rim 156*a* is preferably approximately one inch in height. Circular piston rubber end cup 156 immediately flares, and thereby airseals circular raised rim 156*a* whenever compressed gas enters inlet 111 and flows through air channel segments 164 and air apertures 158*a*, 159*b*. This air seal occurs by compression of raised circular rim 156*a* against interior cylindrical wall surface 101*cc* by pressurized gas.

Inner Ring 113*h*

Referring initially to FIGS. 5 and 7 of the preferred embodiment, inner ring 113*h* encloses distal cylinder end 104*b* in my fully assembled shoring device 100*a*. Inner ring 113*h* is shaped as a hollow cylindrical segment and has an inner wall surface, an outer wall surface, and a wall thickness. Inner ring 113*h* attaches to cylinder 101 by first inner set screw 113*a* and second inner set screw 113*b*. Inner set screws 113*a*, 113*b* oppose each other at approximately 180 degrees along cylinder 101. Inner ring 113*h* is preferably approximately three inches in width parallel to the long axis of cylinder 101, and approximately twelve and one-half inches in outer circumference. Inner ring 113*h* has a proximal ring edge 113*c* and a distal ring edge 113*d*, both of which are beveled.

Inner ring 113*h* is preferably approximately ¼ inch in thickness at distal ring edge 113*d* and proximal ring edge 113*c*. Referring to FIG. 10, inner ring 113*h* also comprises a metal inner continuous circular lip 180 at beveled distal ring edge 113*d*. Metal inner continuous circular lip 180 is continuous with beveled distal ring edge 113*d*, and lip 180 is approximately perpendicular thereto. Metal inner continuous circular lip 180 fits over cylinder distal end 104*b* and prevents inner ring 113*h* from sliding along cylinder 101 (in addition to opposing inner set screws 113*a*, 113*b*).

Metal inner continuous circular lip 180 is approximately one-half inch wide, approximately one-half inch in thickness, and approximately three inches in inner diameter in the preferred embodiment. However, other dimensions of circular metal lip 180 are within the scope of my invention.

Referring to FIGS. 7 and 10 of the preferred embodiment, approximately 1 and ⅝ inches above proximal ring edge 113*c* lies circular continuous indentation 113*i*. Circular continuous indentation 113*i* is uniform in width (approximately ¾ inch) and depth (approximately ⅛ inch). First and second continuous indentation walls 113*p*, 113*q* respectively are perpendicular to circular continuous indentation floor 113*j*. First and second continuous indentation walls 113*p*, 113*q* are also the same height as indentation depth (i.e, approximately ⅛ inch). However, other width and depth measurements are also within the scope of my invention.

Outer Cam Collar 107*t*

Referring initially to FIG. 2 of the preferred embodiment, outer cam collar 107*t* can move axially from piston distal end 102*b* to cylinder distal end 104*b*. As seen in FIGS. 3 and 5 of the preferred embodiment, after assembly outer cam collar 107*ht* completely encloses inner ring 113*h*.

Outer cam collar wall 107*c* is preferably approximately one-quarter (¼) inch in thickness and approximately four and one-quarter (4 and ¼) inches at its greatest axial width. In the preferred embodiment, outer cam collar 107*t* has an outer diameter of approximately 13 inches. Outer cam collar 107*t* is approximately four inches wide at its narrowest outer width. However, other widths, diameters and thickness are also within the scope of my invention.

Referring now to FIGS. 6 and 7 of the preferred embodiment, outer cam collar 107*t* comprises a plurality of handles 115*a*, 115*b*, 115*c*, etc. (generically handles 115). Handles 115 are integral oblong components of outer cam collar 107*t*, and preferably are of two types:

(i) approximately four and one-quarter (4 and ¼) inches in axial and ⅓ (one third) inch in height (115*b* length (115*b*, 115*c*, 115*e*, 115*f*); and (ii) approximately four and one-quarter (4 and ¼) inches in length and one and three quarters (1 and ¾) inches in height (115*a*, 115*d*).

In the preferred embodiment, there are six handles; four of these six handles are the shorter height handle 115. However, other heights, shapes, lengths, numbers and types of handles are also within the scope of my invention. Referring to FIG. 7, handles 115 are aligned parallel to each other and approximately perpendicular to the midline circumference 108 of outer cam collar 107*t*. Preferably, approximately 3 and ½ inches separate adjoining handles 115*b*, 115*c*, while approximately 3 and ½ inches separate adjoining handles 115*e* and 115*f*. Outer cam collar 107*t* also comprises a threaded vertical screw 176, by which metal cam pin 170 is tethered to outer cam collar 107*t* by steel lanyard 145.

As best seen in FIGS. 6 and 7 of the preferred embodiment, proximal outer cam collar edge 107*a* is uniformly round and smooth. Proximal outer cam collar edge 107*a* is preferably approximately one quarter (¼) inch in uniform thickness. Distal cam collar edge 107*b* comprises 180 degree-opposing vertical first and second stop faces 107*f*, 107*g* respectively. Continuous with stop faces 107*f*, 107*g* are corresponding first and second sloping cam edges 107*h*, 107*i* respectively. Sloping cam edges 107*h*, 107*i* form cam surfaces for abutting metal cam pin 170, infra.

Referring now to FIGS. 7 and 10 of the preferred embodiment, outer cam collar 107*t* comprises inner collar surface 107*k*. Inner collar surface 107*k* comprises wider circular proximal step 167 and narrow circular distal step 168. Each step 167, 168 is axially aligned along cylinder 101, so distal narrower step 168 is nearest distal piston end 102*b* in assembled shoring device 100*a*. Wider proximal step 167 comprises a wider inner diameter. This wider diameter allows outer cam collar 107*h* to slide over (i) piston 102, and then (ii) inner cam ring 113*h* until circular metal lip 180 engages narrower distal step 168.

Wider circular proximal step 167 is approximately four inches in interior diameter and approximately preferably 2.8 inches in interior axial length. Circular distal narrower step 168 is preferably approximately three inches in interior diameter and approximately 2.5 inches in interior axial length. Without narrow circular distal step 168, outer cam collar 107*t* slides along cylinder 102 prior to adjustment with threaded cam pin 185, infra.

As best seen in FIG. 7, between first and second short handles 115*b*, 115*c* respectively is an abutting element which penetrates outer cam collar 107*t*. In the preferred embodiment, abutting element comprises a threaded pin 181 which is removable from an integral threaded boss 181*a*. Threaded pin 181 comprises a pin handle 181*b* which is approximately three and one-half inches in length. Threaded stem 181*c* inserts into threaded interior of handle 181*b* and is further attached with suitable solder. Integral threaded boss 181*a* is approximately one inch in diameter and one-half inch in height.

Threaded stem 181*c* is approximately one inch in length and approximately three-eighths inch in diameter at furthermost stem point 181*e*. Threaded stem 181*c* penetrates cam collar wall 107*c* through threaded boss 181*a* and threaded wall aperture 181*d*. When threaded stem 181*c* sufficiently protrudes through threaded wall aperture 181*d*, furthermost stem point 181*e* tightly abuts indentation floor 113*j* (whenever the operator manually turns threaded pin handle 181*d* as tightly clockwise as possible).

Other lengths and diameters of threaded pins 181 are also within the scope of my invention. To release threaded pin 181, the operator turns threaded pin handle 181*b* counter clockwise, so furthermost stem point 181*e* releases from indentation floor 113*j*. After release, the operator can rotate outer cam collar 107*t* or move it along piston 102. Because indentation floor 113*j* is continuous and smooth, threaded pin 181 can abut within the entire width and circumference of indentation floor 113*j*.

In addition my inner ring design enables the operator to loosen the threaded pin 181 from contact with indentation floor 113*j* while threaded in 181 remains within the continuous indentation walls 113*p*,113*q*. This feature allows the outer cam collar 107*t* to rotate during transport or installation while eliminating inadvertent movement of outer cam collar 107.

Prior Art U-Shaped Removable Side Plate 570

Figure 12:
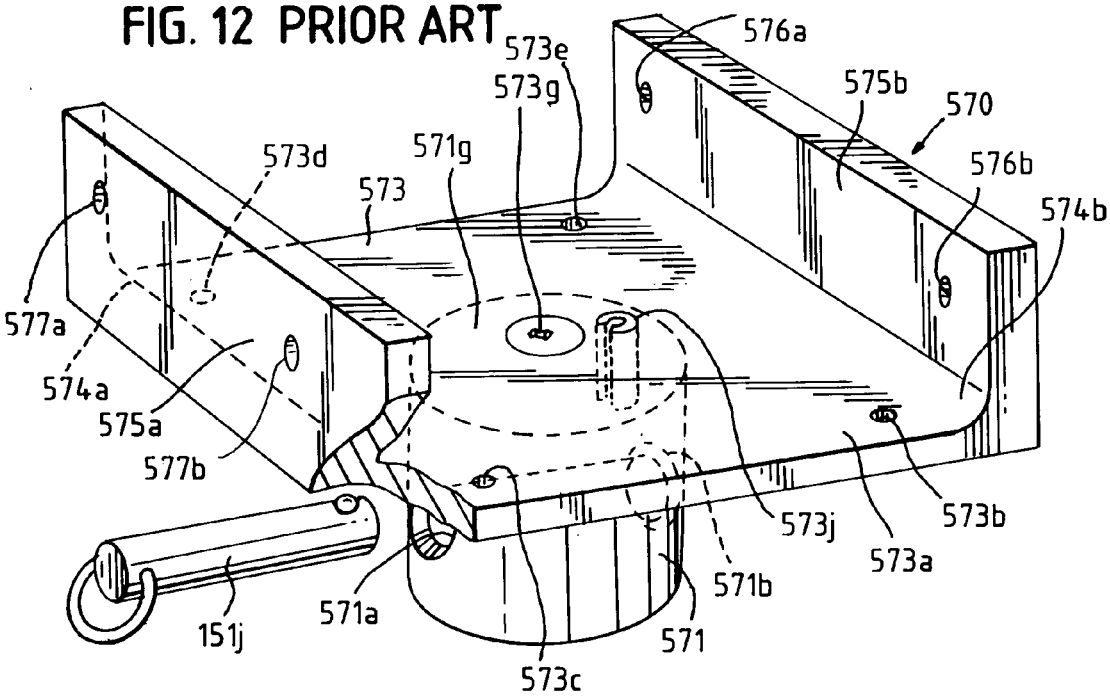
FIG. 12 PRIOR ART
FIG. 12 illustrates a close up isolated partial perspective view of a prior art side plate.

Referring now to FIG. 12, prior art U-shaped removable side plate 570 is useful for trench applications of preferred pneumatic shoring device 100*a*. It also attaches to vertical and angled non-pneumatic embodiments of shoring device 100*a* which support collapsed buildings and unstable motor vehicles. U-shaped removable side plate 570 attaches to proximal cylinder end 104*a* or distal piston end 102*b*. Removable U-shaped side plate 570 comprises a circular (in cross-section) solid metal base 571. Solid metal base 571 supports U-shaped flat plate 573 upon a flat horizontal supporting surface 8. Solid metal base 571 also comprises a first and second solid metal base apertures 571*a*, 571*b* respectively. Solid metal base apertures 571*a*, 571*b* oppose each other at approximately 180 degrees.

Whenever U-shaped removable side plate 570 inserts into distal piston end 102*b* or proximal cylinder end 104*a*, the operator congruently aligns apertures 571*a*, 571*b* with cylinder apertures 116*a*, 116*b* or piston apertures 128/130, 129/131, as the case may be. The operator then inserts metal detente pin 151*j* through these congruently aligned four apertures, to secure removable U-shaped side plate 570 within either cylinder end 104*a* or piston end 102*b*. U-shaped removable side plate 570 similarly inserts into distal piston extension end 500*b* or piston adjustable add-on segment 520.

Still referring to FIG. 12, solid metal base 571 has an upper circular metal base surface 571*g*, to which U-shaped flat plate 573 attaches by large allen screw/washer 573*g*. U-shaped flat plate 573 comprises a flat horizontal upper surface 573*a*. Upper surface 573 has small first, second, third and four base apertures 573*b*, 573*c*, 573*d*, 573*e* respectively. U-shaped flat plate 573 is approximately 0.25 inch in thickness. Piston extensions 500 and piston add-on segments 520 are interchangeably attached to removable U-shaped side plate 570 or removable swivel side plates 103*a*, 103*b*.

Still referring to FIG. 12, U-shaped flat plate 573 has a first opposing edge 574*a* and second opposing edge 574*b*. Integrally attached to each edge 574*a*, 574*b* is a first and second upwardly protruding side wall 575*a*, 575*b* respectively. Each upwardly protruding side wall 575*a*, 575*b* is approximately 2.0 inches in height and approximately 3/16 inch in thickness. Upwardly protruding side walls 574*a*, 575*b* engage wooden boards within a trench or grasp a wooden beam of varying widths. Representative widths (and lengths) of wooden boards include: six inches by six inches; eight inches by eight inches, or four inches by four inches. However, other sizes and dimensions are also within the scope of my invention.

Still referring to FIG. 11, each upwardly protruding side wall 575*a*, 575*b* contains first and second small side wall apertures 576*a*, 576*b* and third and fourth small side wall apertures 577*a*, 577*b* respectively (generically small side wall apertures 576, 577). Small side wall apertures 576,577 are each located at upper corners of the corresponding upwardly protruding side wall 575*a*, 575*b*, as seen in FIG. 11. Apertures 573 and small side wall apertures 576,577 provide insertion points for nails or screws into the supported object, thereby reducing inadvertent movement. Small roll pin 573*j* adjacent to alien screw 573 also attaches solid metal base 571 to U-shaped flat plate 573.

Prior art removable U-plates 570 are made of 6061-T6 aluminum and are available from:

Airshore
Unit 3, 19695 92A Avenue
Langley, BC V1M 3B3
Canada.

However, other embodiments of U-shaped removable plates 570 are also within the scope of my invention.

Assembly of One Shoring Device 100*a*

Each shoring device 100*a* is assembled exterior to a trench or structure to be shored or propped. The operator initially bolts rubber piston end cup 156 to proximal piston end 102*a*, while cylinder circular end cup 155*b* is bolted to distal end 155*i* of cylinder plug 155. Cylinder plug 155 is then inserted into proximal end 104*a* of cylinder 101 and attached thereto with screws 160*a*, 160*b*. The operator then inserts piston 102 into distal end 104*b* of cylinder 101 until cylinder rubber end cup 155*b* abuts piston circular rubber end cup 156.

The operator now slides inner ring 113*h* over cylinder 101 until metal continuous inner circular metal lip 180 engages cylinder distal end 104*b*. The operator attaches inner ring 113*h* to cylinder 101 with two screws 113*a*, 113*b*, and then positions outer cam collar 107*t* over inner ring 113*h*.

As the last assembly step, the operator inserts removable swivel endplate 103*a* into proximal cylinder end 104*a*, and inserts removable swivel endplate 103*b* into distal piston end 102*b*. The operator aligns first and second cylinder apertures 116*a*, 116*b* to congruently align with proximal swivel side plate apertures 103*c*, 103*d*. He or she then takes a proximal swivel side plate detente pin 105*a* and inserts it through properly aligned side plate apertures 103*c*,103*d* and cylinder apertures 116*a*,116*b*.

Swivel side plate detente pin 105*a* now attaches proximal swivel side plate 103*a* within cylindrical plug 155. The operator inserts distal swivel side plate detente pin 105*b* through congruently aligned opposing piston apertures 128/130 or 129/131 and second swivel side plate apertures 141*a*,141*b*. Distal swivel piston side plate detente pin 105*b* now attaches removable distal swivel side plate 103*b* to distal cylinder end 102*b*. Tethered cam metal pin 170 is preferably temporarily inserted through an empty piston aperture, to prevent dragging and dangling outside the shoring area.

Operating Shoring Device 100*a*

My improved pin and collar shoring device 100*a* should never be operated except under lawful conditions and at the site of the shoring operation, infra. My improved shoring device 100*a* operates in an extended position in which pressurized air initially forces piston 102 laterally from cylinder 100. Other applications such as vehicles and buildings require manual extension, as discussed supra.

To maintain this extended lateral piston position in pneumatic and non-pneumatic applications, the operator first manually rotates outer cam collar 107*h* clockwise, until a specific aperture 128, 129, 130, 131 is closest to sloping cam surface 107*i* or 107*h*. Please see FIG. 7 (129*a*/131*a*).

He or she then inserts tethered metal cam pin 170 within that closest piston aperture and through its 180-degree opposing piston aperture. For example, if the operator inserts straight cam metal pin 170 through piston aperture 128*b*, then straight cam metal pin 170 also inserts within opposing piston aperture 130*b*. The operator continues to rotate outer cam collar 107*t* clockwise until straight metal cam pin 170 firmly abuts the closest sloping cam surface 107*i* or 107*j*, as the case may be. After abutment occurs, the operator obtains a maximum tight fit by rotating threaded pin 181 until he or she detects the abutment of furthermost point 180*e* with indentation floor 113*d*.

Without additional pressurized air flowing to my shoring device 100*a* cylinder 101 and piston 102 remain laterally extended, This extension continues because outer cam collar 107*t* and inner cam ring 113*h* prevent counter-clockwise rotational piston movement and subsequent slippage from cylinder 101. To disengage outer cam collar 107*t* the operator rotates outer cam collar 107*t* in a counter-clockwise direction and releases threaded pin 181 by rotating pin handle 181*b* counter clockwise. He or she continues to rotate outer cam collar 107*t* until straight metal cam pin 170 no longer abuts either sloping cam surface 107*i*, 107*j*. The operator then removes straight metal cam pin 170.

Vent holes 112 within cylinder wall 101*d*, release gas from cylinder 101 whenever piston 102 extends from cylinder 101 sufficiently for piston rubber end cup 156 to pass beyond vent holes 112. As a result of vent holes 112, no further extension of shoring device 100*a* occurs, because the air pressure dissipates. The preferred number of vent holes 112 is four, but other numbers are also satisfactory.

Installation of Multiple Shoring Devices 100*a* in an Excavation or Trench

The operator always installs a plurality of my improved shoring devices 100*a* in progression from the top of the trench to the bottom of the trench. For horizontal and vertical placement requirements of trench supports for pneumatic shoring devices 100*a*, please see attached Exhibits A (Timber and Plywood) and B (Aluminum Wale-Plates). The best mode installation and removal procedure proceeds as follows:

1. The operator initially determines appropriate reinforcement measurements according to 29 C.F. 1926.652 (Federal Register, Vol. 54(209): 45961–62, Oct. 31, 1989) (Requirements for protective systems). Under this regulation, the engineer's data in Exhibits A and B determines the horizontal and vertical spacing between wale plates or wood supports, according to trench depth and soil type. However, these measurement in Exhibits A and B are only application to my preferred embodiment shoring device 100*a*. The measurements must be recalculated for other embodiments or sizes of shoring device 100*a*, as well as other soil types and trench depth. Soil type A-25 comprises cohesive soils with unconfined compressive strength of at least 1.5 tons per square foot (uch as clay and cemented soils). Class B-45 is cohesive soil with an unconfined compressive strength greater than 0.5, but less than 1.5 tons per square foot (such as sandy loam and city loam. Department of Labor, 29 C.F.R. 1926 (Federal Register, Vol. 54 (209): 45939, Oct. 31, 1989).

(100) For example:

(a) The installer can position a wooden board which is approximately 2 inches thick by 10 inches wide (designated as an "upright" in this industry) on each opposing trench wall surface. The operator can force these boards further into each trench wall using pressurized air, infra. Please see FIG. 1. The length of these boards varies, depending upon the dimensions of a trench or other application.

(b) In other circumstances, the operator can position an approximately 12-inch tall aluminum wale-plate at each end of shoring device 100*a*. These wale-plates are approximately six inches wide and approximately 2 and ½ inch in thickness, and they eliminate the need for upright wooden boards.

(c) The operator then selects the proper size and number of shoring devices 100*a* required to shore or prop the trench effectively. The installer positions plywood, timber uprights or aluminum wale-plates as required after he has descended into the trench, infra. FIG. 1 illustrates a plurality of shoring devices 100*a* in a trench, and in which shoring devices 100*a* support first and second wooden shoring boards and/or aluminum wale-plates.

2. The operator next determines that outer cam collar 107*t* is properly positioned over inner cam ring 113*h*. Prior to installation, the installer will often place tethered straight cam metal pin 170 into one piston aperture 128, 129, 130, 131 to prevent straight cam metal pin 170 from dangling. However, the installer must remove tethered straight cam metal pin 170 prior to pressurizing shoring device 100*a*, or straight cam metal pin 170 will prevent full extension of piston 102.

(a) The installation pressure is the air pressure required to expand piston 102 laterally from cylinder 101, thus forcing the upright wooden boards and/or aluminum wale-plates into opposing trench walls with attached swivel side plates 103*a*, 103*b*. The preferred embodiment of my shoring device 100*a* requires an installation pressure of approximately 115 to 225 pounds per square inch in the best mode.

(b) Under this compressed gas or air pressure, piston 102 extends laterally and distally until both removable swivel side plates both 103*a*, 103*b* bear against the wooden shoring boards and/or or wale-plates. First set screw 120*a* and second set screw 120*b* quickly engage the wooden shoring boards or aluminum wale-plates after introduction of pressurized air, thus preventing board or wale-plate random movement.

(c) In the best mode, there are at least two shoring devices in one trench whenever shoring devices 100*a* are the sole protection from wall collapse. For trenches with a depth greater than eight feet, in the best mode there should be a shored length of trench at least equal to its depth. For example, a trench that is twenty feet long and nine feet deep should have at least nine feet of its length shored, or propped, by my shoring device 100*a*.

3. The operator next places a ladder in the trench and descends until his waist is even with the top of the trench. Third persons outside the trench assist by lowering the shoring device 100*a* to the descending operator with either a rope or webbing.

The installer now positions shoring device 100*a* to the required or desired depth (i.e., no deeper than two feet for the uppermost initial placement, and then no greater than four feet thereafter) within the trench, but he himself does not descend into the trench below his waist. The installer levels shoring device 100*a* to the horizontal (i.e., parallel to the floor of the trench) and authorizes air pressure to shoring device 100*a* from third persons. This air pressure results in immediate lateral extension of piston 102 within cylinder 101.

4. Vent holes 112 give an audible indication whenever piston 102, which must remain within cylinder 101, reaches its maximum extended position. This indication occurs whenever approximately ⅓ of piston 102 remains within cylinder 101 At this time, if additional shoring device 10*a* length is required, then the operator obtains a shoring device with a greater lateral extension.

(a) With piston 102 now fully extended from applied air pressure, the operator rotates outer cam collar 107*a* clockwise, until a piston aperture 128, 129, 130, or 131 is closest to a sloping cam surface 107*i*, 107.

(b) He oro she then inserts a straight metal cam pin 170 through this piston aperture and its 180-degree opposing counterpart, such as 128*c*/130*c*, 129*b*/131*b*, as examples. The operator continues to rotate outer cam collar 107*a* until straight cam metal pin 170 firmly abuts either sloping cam surfaces 107*i* or 107*j*.

5. Immediately after straight metal cam pin 170 engages either sloping cam surface 107*i*, 107*j*, the operator continues to rotate outer cam collar 107*a* until collar 107*a* can no longer move clockwise. This engagement prevents piston 102 from rotating counter-clockwise and retracting into cylinder 101. This result occurs because mechanically engaged inner cam collar 107*t* and inner ring 113*h* (i) tightly abut each other when rotated threaded cam pin 181 lodges against indentation floor 113*j*; and (ii) are simultaneously tightly locked against piston 102 and cylinder 101. This combination also presses stop faces 107*i*, 107*j* and cam surfaces 107*f* and 107*g* directly against piston 102.

Inner ring 113*h* also grasps piston 102 directly and is braced against counterclockwise rotational force by screws 113*a*, 113*b* which connect inner ring 113*h* to cylinder 101. Please see FIG. 7. In addition, straight cam metal pin 170 prevents piston 102 from retracting into cylinder 101 or collapsing onto the trench floor.

6. Once outer cam collar 107*t* and inner ring 113*h* tightly abut through straight metal pin 170 and threaded pin 181, the operator signals third persons to remove exterior air pressure from the now extended shoring device 100*a*. The air hose is then removed from the leveled shoring device 100*a* to attach to another shoring device 100*a*. This particular shoring device 100*a* is now in its extended longitudinal position, and swivel side plates 103*a*, 103*b* engage opposing wood shoring boards and/or aluminum wale-plates with set screws 120.

7. Now that first shoring device 100*a* is installed, the installer can further descend the ladder within the trench, until his waist is even with the level of this initial installed shoring device 100*a*. He then prepares to install a second shoring device 100*a* at a greater depth within the same trench. As the operator progresses deeper into the trench, his next "level of protection" is waist height with last installed shoring device 100*a*.

In the best mode of applying improved shoring device 100*a*, the operator uses two-inch by ten-inch Douglas fir timber uprights or aluminum 12-inch wale-plates. Aluminum wale-plates are positioned horizontally or vertically. Plywood, timber uprights, and 12-inch wale-plates are all satisfactory, as long as these items continuously contact trench walls with no gaps or voids. Plywood sheeting is required in all trenches, regardless of depth, if the operator observes sloughing or raveling (movement of soil around or between shoring elements).

In the best mode and preferred embodiment, shoring device 100*a* is strongest whenever the operator positions it completely horizontally within the trench. However, other embodiments support structures for which a shoring device 100*a* is most effective when positioned vertically. With these embodiments, base plates in place of swivel side plates 103*a*, 103*b* are necessary for vertical positions. For example, with a single or a plurality of shoring devices 100*a*, a vertical position (or small angle from the vertical) from the supporting flat surface is recommended for shoring of a vehicle or structure such as a house. In the preferred embodiment shoring device 100*a* is installed at an angle which deviates from the horizontal no more than 15 degrees.

Depending upon the circumstances, the engineer may require plywood in addition to either wooden upright boards or wale-plates. Where plywood is necessary, it is preferably 1 and ⅛ inch Douglas fir or 14-ply white birch. Douglas fir is a tree species, while a "number 2" designation refers to the wood quality and grade. These particular designations are well known in the rescue industry, as well as the lumber industry. The plywood must be at a minimum: 1 and ⅛ inch thick, approximately four feet wide and approximately eight feet long.

Alternatively, the installer can use the 14-ply (fourteen layers glued or laminated together) white birch plywood, which is approximately ¾ inch thick, four feet wide and eight feet in length. Other dimensions are also within the scope of my invention, as the operator is not limited to a certain plywood size.

Removal of Multiple Shoring Devices 100*a* within an Excavation or Trench

In a reverse chronology of the installation described immediately supra, the operator always removes a plurality of shoring devices 100*a* from the trench bottom to the upper trench edge. In this manner, the operator remains waist high to the last extended installed shoring device 100*a* within a trench. An operator at this "level of protection" is either completely exterior to the trench or at the level of the next highest fully installed shoring device 100*a*. In the proper level, the operator next follows these steps:

1. Prior to disengagement and removal of each shoring device 100*a*, air pressure is re-introduced through gas inlet 111 by a method well known in this particular industry. After re-introduction of air pressure, the operator releases threaded pin 181 by turning handle 181*b* counter-clockwise and removing threaded stem 180 from contact with indentation floor 113*d*. Each shoring device 100*a* requires the same pressure upon removal from the trench as it did during installation.

2. With threaded pin 181 no longer in contact with indentation floor 113*d*, the operator rotates outer cam collar 107*t* counterclockwise until straight metal cam pin 170 no longer abuts sloping cam surface 107*f*. He or she then removes straight metal cam in 170 to retract shoring device 100*a*.

In sum, the operator removes the shoring device 100*a* with the same procedures as for installation, except that he or she need not rotate outer cam collar 107 clockwise. Instead, the operator rotates threaded pin 181 by handle 181*b* counterclockwise to release outer cam collar 107, thereby requiring less exertion.

(a) Shoring device 100*a* does not collapse at this point, because the air pressure provides continuing extension of piston 102. Without the continuing air pressure to a shoring device 100*a* without pin support, the trench wall could collapse.

(b) With the air pressure still connected to gas inlet 111, the operator now ascends the ladder to either remove another shoring device 100*a*, or exit the trench. After the operator is in a safe position, the air pressure through gas inlet 111 is removed, and third persons assist in lifting this particular shoring device 100*a* from the trench with rope or a webbing material.

Wherever possible, back filling replaces soil which was removed from a trench prior to the above-described operation. In the best mode of using my device 100*a*, back filling is recommended after all shoring devices 100*a* are removed from the trench, and after the trench operation is complete. In the best mode, for trenches with a depth greater than eight feet, the length of the trench shored should equal the actual trench depth. Back filling can also be by concrete or wooden blocks, and is completed as each shoring device 100*a* is removed.

Operators should not use my shoring device 100*a* in trenches, which are wider than 15 feet or at a depth other than five to twenty feet. For depths greater than twenty feet, a registered engineer should be consulted for the appropriate wood or wale-plate shoring requirements.

Materials Comprising Shoring Device 100*a*

(1) The preferred straight cam metal pins 170 are available from:

PivotPoint
P.O. Box 488
Hustisford, Wis. 53034

Straight cam metal pins 170 have round "key rings" at the upper end of each pin to prevent slippage through piston 102. The recommended models are:

(a) ⅝ inch by 3.5-inch detente ring pins 105*c* with a collar (12L14Carbon Steel Zinc w/ yellow chromate finish or stainless steel), where ⅝ inch is the diameter of the pin shaft;

(b) ⅝ inch by four and ¾ inch ring pin with collars (Grade 5, 1144 carbon steel with zinc and yellow chromate finish); and (c) 5/32×1 and ¼ inch, 4–20 stainless steel slotted spring pin. Detente pins 105*a*, 105*b* with small detente beads 45 (See FIG. 3), are preferably made of carbon steel or stainless steel.

(2) Aluminum sand casted components such as inner ring 113*h*, outer cam collar 107*t*, threaded cam pin 181, cylinder plug 155 and swivel side plates 103*a*, 103*b* are custom made by:

Louis Meskan Foundry
2007-13 North Major Ave.
Chicago, Ill. 60639

These 356-T components are made by initially pouring molten metal into a mold and are designated in the industry as "sand castings."

(3) Aluminum extruded cylinders 101, pistons 102 and 12-inch aluminum wale-plates are custom made by:

Precision Extrusions
720 East Green Street
Bensenville, Ill. 60106

The preferred material for cylinder 101 is aluminum type 6061-T6, which is extruded, and the dipped in cold water during a process well known in this particular industry. The pistons 102 and wale-plates are also of the 6061-T6 variety.

(4) Circular rubber (55 durometer neoprene) end cups 155*b*, 156 are custom-made by:

Packing Seals, Inc.
3507 North Kenton Ave.
Chicago, Ill. 60641

(5) The polyvinyl chloride coated stainless steel lanyard 145 which connects straight metal cam pin 170 to outer cam collar 107 is available from:

Lexco Cable
2738 West Belmont Ave.
Chicago, Ill. 60618

Model: 3/32, 7×7 G.A.C. (galvanized aircraft cable) coated with 3/16 clear polyvinyl chloride The above is a description of the preferred embodiment of my improved shoring device 100, as well as the best mode of its application. However, these skilled in the art may envision other possible variations within the invention's scope, by changing the dimensions and shapes of its components. Accordingly, since my invention is possible in other specific forms without departing from the spirit or essential characteristics thereof, the embodiments described herein are considered in all respects illustrative and not restrictive.

All changes, which come within the meaning and range of equivalency of the claims, are intended to be included therein. As such, this above discussion describes the preferred embodiment, but in no way limits the scope of my invention. In addition, the detailed description of my attachments and extensions in no manner limits the spirit or scope of additional accessories, which are compatible with the scope of my invention.

I claim:

1. A shoring device, said shoring device comprising:

(A) a piston and a cylinder, said cylinder partially enclosing said piston, said piston and said cylinder each comprising an interior wall, said cylinder having a longitudinal axis and said piston having a longitudinal axis, said piston and said cylinder each comprising a distal end and a proximal end, said piston and said cylinder each comprising an exterior wall, each said piston and cylinder comprising an interior wall and a pre-determined wall thickness, (B) at least one straight metal cam pin, and (C) a mechanical device, said mechanical device encircling said piston and said cylinder, said mechanical device comprising in combination, (1) an outer cam collar, said outer cam collar comprising an abutting element, said abutting element penetrating said outer cam collar, said outer cam collar movably positioned along said longitudinal axis of said piston, said outer cam collar engaging said cylinder and said piston, (2) an inner ring, said inner ring attached to and encircling said cylinder, said inner ring comprising an inner ring circumference, said inner ring comprising a continuous circular indentation along said inner ring circumference, said continuous circular indentation comprising an indentation floor, said continuous circular indentation comprising a depth and a width, said outer cam collar concentrically enclosing said inner ring, whereby said abutting element prevents rotational movement of said cylinder relative to said piston by tightly abutting said indentation floor.

2. A shoring device as described in claim 1, wherein said abutting element is a flat threaded pin.

3. A shoring device as described in claim 2, wherein said outer cam collar comprises a threaded wall aperture, said threaded wall aperture adapted to reversibly receive said flat threaded pin.

4. A shoring device as described in claim 3, wherein said outer cam collar comprises a plurality of handles, said outer cam collar further comprising an integral threaded boss for insertion of said flat threaded pin.

5. A shoring device as described in claim 1, said shoring device further comprising at least one U-shaped removable side plate, said U-shaped removable side plate reversibly attaching to said cylinder or said piston by insertion of a détente pin through apertures.

6. The shoring device as described in claim 5, wherein said circular continuous indentation comprises a first indentation wall and a second indentation wall, said first and second indentation walls being perpendicular to said circular continuous indentation floor.

7. The shoring device as described in claim 6, wherein said first indentation wall and said second indentations wall are each approximately one-eighth inch in height and said indentation floor is approximately three-quarters inch in width and smooth.

8. The shoring device as described as described in claim 1, wherein said outer cam collar comprises a first and a second cam stop face, each said cam stop face adapted to tightly abut a straight metal cam pin inserted through said device.

9. A shoring device as described in claim 1, wherein said shoring device expands longitudinally by extrinsic air pressure, said air pressure entering said cylinder at only one specific numerical value.

10. A pneumatic shoring device for shoring of trenches comprising (A) a cylinder which is hollow and cylindrical in shape, said cylinder comprising a removable attachable cylinder swivel side plate at a proximal cylinder end, said attachable cylinder swivel proximal side plate engaging with a shoring board lining a wall, said cylinder further comprising an inlet for pressurized gas at a single numerical value from an exterior source, said cylinder further comprising a cylindrical plug, (B) a piston, said piston being hollow and cylindrical in shape, said piston comprising a lesser diameter than said cylinder, said piston comprising a removable swivel distal piston side plate at said distal piston end for engagement with wooden boards, said piston further comprising a piston rubber end cup, said piston rubber end cup secured at said proximal end of said piston, (a) said rubber piston end cup creating an airseal, (b) said piston comprising a plurality of linearly aligned axial longitudinal apertures, (C) an outer cam collar, said outer cam collar comprising a collar interior surface, said collar interior surface comprising one distal step and one proximal step, said distal step comprising a narrow diameter than said proximal step, said distal step abutting said proximal end of said piston when said piston is axially inserted into said cylinder, (1) said outer cam collar rotating around said distal end of said cylinder, said outer cam collar having an axially extending distal edge surrounding said piston, said distal edge comprising a cam surface comprising two vertical stop faces and two continuous sloping cam surfaces, (2) said outer cam collar further comprising in combination an abutting element, said abutting element comprising a threaded pin, (D) an inner ring, said inner ring comprising a hollow cylindrical segment, said inner ring enclosing said distal cylinder end, said inner ring attaching to said cylinder with mechanical fasteners, said inner ring positioned concentrically beneath said outer cam collar whenever said pneumatic shoring device is fully assembled, said inner ring comprising a proximal edge and a distal edge, said inner ring comprising at least one circumference which is parallel to said proximal edge and said distal edge, said inner ring further comprising (a) a continuous circular indentation along said circumference of said inner ring, said continuous circular indentation comprising a smooth continuous indentation floor, said continuous circular indentation comprising a first perpendicular wall and a second perpendicular wall, said continuous circular indentation being uniform in width and depth, said first and second perpendicular walls being perpendicular to said smooth continuous indentation floor, said inner ring comprising apertures for at least two set screws, (b) said threaded pin penetrating said exterior cam collar wall and tightly abutting said smooth continuous indentation floor, said inner ring thereby stabilizing said outer cam collar rotationally, whenever said piston is inserted within said cylinder, (E) a straight metal cam pin, said straight metal cam pin reversibly inserting within one pair of opposing apertures within said piston, whereby after introduction of pressurized gas into said cylinder, said piston extends laterally after said piston rubber end cup creates an air seal, said piston and cylinder being secured in the resulting extended condition by said straight metal cam pin abutting said cam surface, said threaded pin abutting said circular continuous indentation and said inner continuous longitudinal lip abutting said piston.

11. The shoring device as described in claim 10 wherein said inner ring and said outer cam collar comprise aluminum alloy.

12. The shoring device as described in claim 10 wherein the extrinsic air pressure value ranges from approximately 115 pounds per square inch to 150 pounds per square inch.

13. The shoring device as described in claim 10 wherein said threaded pin comprises a threaded pin handle and a threaded stem, said threaded stem inserting within said threaded handle.

14. The pneumatic device as described in claim 10 wherein said inner ring and outer cam collar comprise aluminum sand castings.

15. The shoring device as described in claim 10 wherein said flat threaded pin comprises a furthermost stem point, said furthermost stem point abutting said continuous indentation floor, said furthermost stem point adapted to fit snugly between said indentation walls.

16. The pneumatic shoring device as described in claim 10 wherein said cylinders and said pistons comprise aluminum type alloy.

17. The pneumatic shoring device as described in claim 10 wherein said threaded cam pin comprises a aluminum sand casting.

18. The pneumatic shoring device as described in claim 10 wherein said cylinders and said pistons and said inner ring comprise aluminum alloy, said outer cam collar and said threaded pin comprising aluminum sand castings.

19. The pneumatic shoring device as described in claim 10 wherein said device is approximately 25 inches in length when fully retracted and approximately thirty inches in length when fully extended.

20. The pneumatic shoring device as described in claim 19 wherein said said piston is approximately thirteen inches in length and approximately two and one-quarter inches in inner diameter.

21. The pneumatic shoring device as described in claim 20 wherein said circular continuous indentation is approximately three-quarter inch in width and approximately ⅛ inch in depth.

* * * * *